US008591222B2

(12) United States Patent
Sherrow

(10) Patent No.: US 8,591,222 B2
(45) Date of Patent: Nov. 26, 2013

(54) GAS-FIRED FURNACE WITH CAVITY BURNERS

(75) Inventor: Lester D. Sherrow, Whitehouse, TX (US)

(73) Assignee: Trane International, Inc., Piscataway, NJ (US)

( * ) Notice: Subject to any disclaimer, the term of this patent is extended or adjusted under 35 U.S.C. 154(b) by 330 days.

(21) Appl. No.: 12/609,988

(22) Filed: Oct. 30, 2009

(65) Prior Publication Data

US 2011/0104622 A1 May 5, 2011

(51) Int. Cl.
*F23C 7/00* (2006.01)

(52) U.S. Cl.
USPC ..... 431/353; 431/7; 431/8; 431/170; 431/198; 431/350; 431/351; 431/352; 126/99 A

(58) Field of Classification Search
USPC ..... 431/7, 8, 350–353, 170, 198; 126/99 A
See application file for complete search history.

(56) References Cited

U.S. PATENT DOCUMENTS 3,187,798 A * 6/1965 Pokorny ..... 431/264
3,204,683 A * 9/1965 Ruff et al. ..... 431/249
3,233,653 A * 2/1966 Hachiro et al. ..... 431/329
3,391,983 A * 7/1968 Shinichi et al. ..... 431/329
3,405,921 A 10/1968 Rohrs
3,507,481 A * 4/1970 Hemmert ..... 432/49
RE27,396 E * 6/1972 Hemmert ..... 432/223
3,726,633 A * 4/1973 Vasilakis et al. ..... 431/329
3,733,164 A * 5/1973 Westlake et al. ..... 431/328
3,733,170 A * 5/1973 Kobayashi et al. ..... 431/329
3,736,094 A * 5/1973 Shisler ..... 431/158
3,802,829 A * 4/1974 Morris ..... 431/353
3,947,233 A * 3/1976 Sundberg ..... 431/328
3,994,670 A * 11/1976 Sheridan ..... 431/174
4,480,988 A * 11/1984 Okabayashi et al. ..... 431/329
4,595,356 A * 6/1986 Gaysert et al. ..... 431/352
4,599,066 A * 7/1986 Granberg ..... 431/329

(Continued)

FOREIGN PATENT DOCUMENTS

EP 0512801 A2 11/1992

OTHER PUBLICATIONS

Worgas Bruciatori SRL, Headquarters—R&D—Administration, http://www.worgasit, 2 pages.

(Continued)

*Primary Examiner* — Kenneth Rinehart
*Assistant Examiner* — Jorge Pereiro
(74) *Attorney, Agent, or Firm* — Conley Rose, P.C.; J. Robert Bown, Jr.

(57) ABSTRACT

A gas-fired air conditioning furnace has a cavity burner configured to combust an air-fuel mixture at least partially within an interior space of the cavity burner. A method of operating a gas-fired furnace by flowing an air-fuel mixture into a cavity burner through a perforated wall of the cavity burner, combusting at least a portion of the air-fuel mixture within an interior space of the cavity burner, and flowing at least partially combusted air-fuel mixture into a heat exchanger. A gas-fired air conditioning device has a cavity burner that has a cylindrically shaped body and a cap on a first end of the body, each of the body and the cap being perforated. The device has a cylindrically shaped heat exchanger inlet tube and the cavity burner is at least partially concentrically received within the heat exchanger inlet tube.

12 Claims, 4 Drawing Sheets

(56) References Cited

U.S. PATENT DOCUMENTS

| | | | | | |
|---|---|---|---|---|---|
| 4,657,506 | A | * | 4/1987 | Ihlenfield et al. | 431/329 |
| 4,721,456 | A | * | 1/1988 | Granberg et al. | 431/328 |
| 4,723,513 | A | * | 2/1988 | Vallett et al. | 122/18.4 |
| 4,755,136 | A | * | 7/1988 | Gotte | 431/354 |
| 4,776,320 | A | * | 10/1988 | Ripka et al. | 126/99 A |
| 4,830,600 | A | | 5/1989 | VerShaw et al. | |
| 4,895,137 | A | * | 1/1990 | Jones et al. | 126/391.1 |
| 4,904,179 | A | * | 2/1990 | Drago et al. | 431/2 |
| 4,945,890 | A | * | 8/1990 | Ripka | 126/110 R |
| 4,960,102 | A | * | 10/1990 | Shellenberger | 126/110 R |
| 5,049,066 | A | | 9/1991 | Kaiya et al. | |
| 5,062,409 | A | | 11/1991 | Kamanaka et al. | |
| 5,165,887 | A | * | 11/1992 | Ahmady | 431/329 |
| 5,197,415 | A | * | 3/1993 | Stretch et al. | 122/14.22 |
| 5,211,552 | A | * | 5/1993 | Krill et al. | 431/7 |
| 5,340,305 | A | * | 8/1994 | Joyce | 431/7 |
| 5,368,011 | A | * | 11/1994 | Bodner | 126/116 R |
| 5,393,224 | A | | 2/1995 | Allen et al. | |
| 5,394,862 | A | * | 3/1995 | Firatli et al. | 126/409 |
| 5,427,086 | A | * | 6/1995 | Brownell | 126/110 R |
| 5,447,666 | A | * | 9/1995 | LaFontaine | 264/628 |
| 5,458,484 | A | * | 10/1995 | Ripka | 431/353 |
| 5,520,536 | A | * | 5/1996 | Rodgers et al. | 431/329 |
| 5,527,180 | A | * | 6/1996 | Robinson et al. | 431/258 |
| 5,649,529 | A | * | 7/1997 | Lu et al. | 126/116 R |
| 5,997,285 | A | * | 12/1999 | Carbone et al. | 431/354 |
| 6,004,129 | A | * | 12/1999 | Carbone et al. | 431/354 |
| 6,027,336 | A | * | 2/2000 | Nolte et al. | 431/354 |
| 6,065,962 | A | * | 5/2000 | Shizukuisha et al. | 431/328 |
| RE36,743 | E | * | 6/2000 | Ripka | 431/353 |
| 6,129,545 | A | | 10/2000 | Kahlke et al. | |
| 6,162,049 | A | * | 12/2000 | Pellizzari et al. | 431/326 |
| 6,578,570 | B2 | | 6/2003 | Fogliani et al. | |
| 6,889,686 | B2 | * | 5/2005 | Specht | 126/110 R |
| 6,939,126 | B2 | * | 9/2005 | Boyes | 431/7 |
| 7,455,238 | B2 | * | 11/2008 | Hugghins | 236/15 R |
| 7,909,005 | B2 | * | 3/2011 | Le Mer et al. | 122/31.1 |
| 8,162,237 | B2 | * | 4/2012 | DeGrazia et al. | 239/406 |
| 8,167,610 | B2 | * | 5/2012 | Raleigh et al. | 431/171 |
| 2003/0096204 | A1 | * | 5/2003 | Hermann et al. | 431/7 |
| 2006/0154191 | A1 | | 7/2006 | Gilioli et al. | |
| 2007/0298361 | A1 | | 12/2007 | Fogliani et al. | |
| 2008/0223314 | A1 | * | 9/2008 | Le Mer et al. | 122/53 |
| 2009/0017407 | A1 | | 1/2009 | Fogliani et al. | |
| 2009/0145419 | A1 | * | 6/2009 | Hoeve | 126/116 R |
| 2010/0273120 | A1 | * | 10/2010 | Ten Hoeve | 431/328 |
| 2010/0310998 | A1 | * | 12/2010 | Raleigh et al. | 431/8 |
| 2012/0180774 | A1 | * | 7/2012 | Reifel et al. | 126/116 R |

OTHER PUBLICATIONS

Canadian Notice of Allowance; Application No. 2,718,589; dated Aug. 26, 2013; 2 pages.

* cited by examiner

GAS-FIRED FURNACE WITH CAVITY BURNERS

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Gas-fired furnaces are widely used in commercial and residential environments for heating, including space heating for air conditioning interior spaces. However, gas-fired furnaces are known to generate and emit oxides of nitrogen ($NO_X$). $NO_X$ is a term used herein to describe the various oxides of nitrogen, in particular NO, $N_2O$ and $NO_2$. $NO_X$ emissions from gas-fired furnaces are typically attributable to less than optimal air-fuel mixtures and combustion temperatures.

SUMMARY

In an embodiment, among others, a gas-fired air conditioning furnace is provided that comprises a cavity burner configured to combust an air-fuel mixture at least partially within an interior space of the cavity burner.

In another embodiment, among others, a method of operating a gas-fired furnace is provided. The method comprises flowing an air-fuel mixture into a cavity burner through a perforated wall of the cavity burner, combusting at least a portion of the air-fuel mixture within an interior space of the cavity burner, and flowing at least partially combusted air-fuel mixture into a heat exchanger.

In yet another embodiment, among others, a gas-fired air conditioning device is provided that comprises a cavity burner comprising a cylindrically shaped body and a cap on a first end of the body. Each of the body and the cap are perforated. The device further comprises a cylindrically shaped heat exchanger inlet tube and the cavity burner is at least partially concentrically received within the heat exchanger inlet tube.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or in existence. The disclosure should in no way be limited to the illustrative implementations, drawings, and techniques illustrated below, but may be modified within the scope of the appended claims along with their full scope of equivalents.

Lowering $NO_X$ emissions attributable to a gas-fired furnace may be accomplished by lowering the burn temperature of an air/fuel mixture in the burners of the gas-fired furnace. It may be desirable to lower the $NO_X$ production to below 14 nanograms per joule (ng/J) of energy used. Accordingly, a gas-fired furnace with cavity burners for lowering the burn temperature of an air/fuel mixture is provided. The furnace may comprise one or more cylindrical premix cavity burners similar to the cylindrical metal premix burners sold by Worgas of Formigine, Italy, although other cavity burners may be used. The cavity burners may each be inserted into a heat exchanger inlet tube. The burner tubes may be housed in a heat exchanger inlet tube assembly such that a mixture of air and fuel is provided to a first side of the cavity burners. A second side of the burner tube assembly may be connected to a heat exchanger for venting hot flue gasses, such that the air flow through the furnace passes through the burners.

Figure 1:
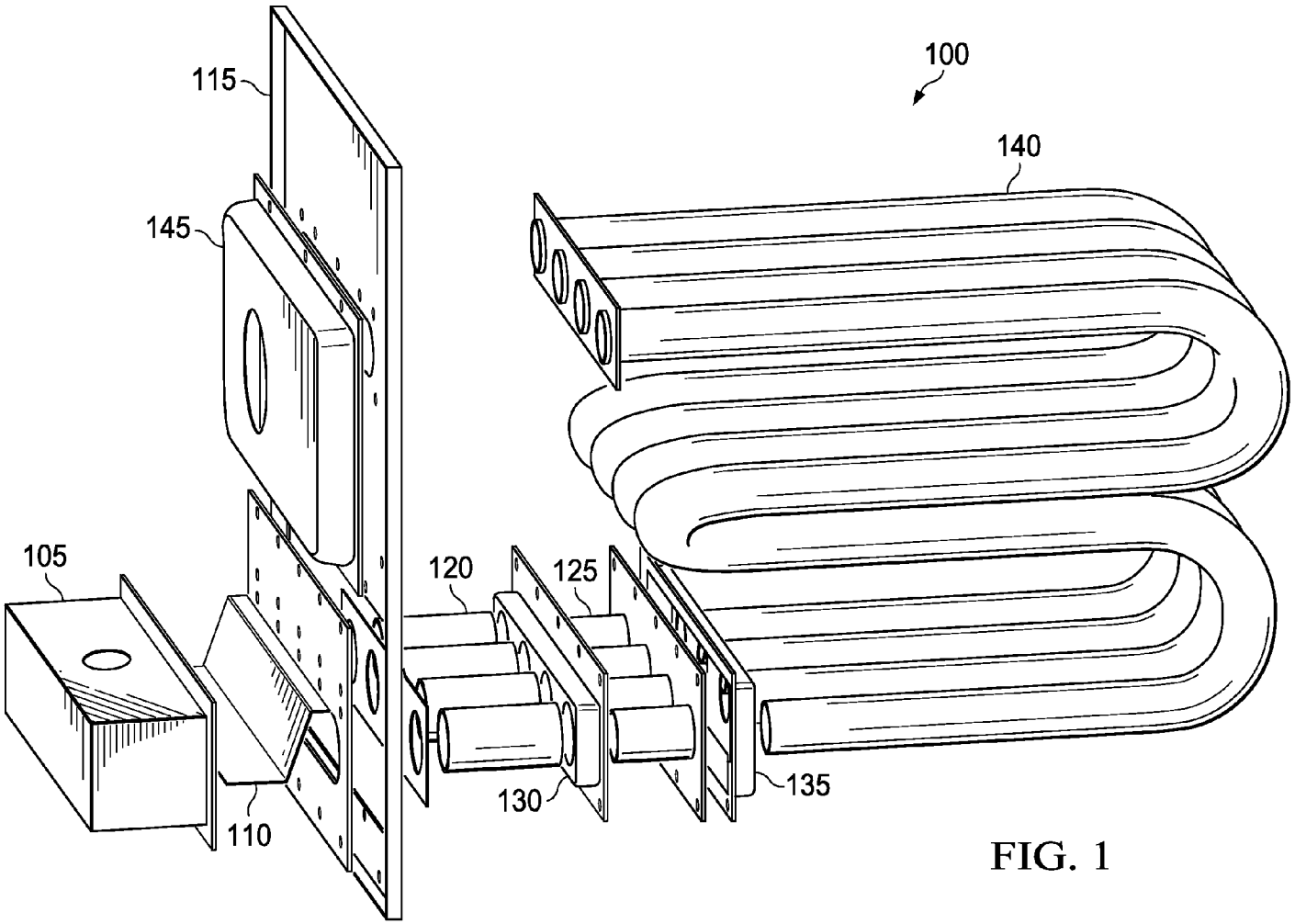
FIG. 1 is an oblique exploded view of a gas-fired furnace comprising cavity burners according to an embodiment of the disclosure.

Referring to FIG. 1, an oblique exploded view of a gas-fired furnace 100 is illustrated. The furnace 100 comprises an air/fuel mixing box 105, an air/fuel mixing baffle 110, a partition panel 115, a plurality of heat exchanger inlet tubes 120, a plurality of cavity burners 125, a burner box 130, a post combustion chamber 135, a plurality of heat exchangers 140, and a heat exchanger exhaust chamber 145.

The air/fuel mixing baffle 110 may be connected to a portion of the partition panel 115 above an opening for the heat exchanger inlet tubes 120. The air/fuel mixing box 105 may be mounted to the partition panel 115 such that a cavity is created around the air/fuel mixing baffle 110 and the openings for the heat exchanger inlet tubes 120. Fuel and air may be introduced to the air/fuel mixing box 105 to allow mixing before combustion. The air/fuel mixing baffle 110 aids in the mixing of air and fuel in the air/fuel mixing box 105 by altering the direction of air and fuel flow through the air/fuel mixing box 105. The mixing of the air and fuel may also be aided by a mixing device to encourage homogeneous mixing of the fuel and combustion air in the air/fuel mixing box 105. Fuel may be introduced to the air/fuel mixing box 105 by a gas supply valve. The gas supply valve may be adjusted either electrically of pneumatically to obtain the correct air to fuel ratio for increased efficiency and lower $NO_X$ emissions. The gas supply valve may be configured for either staged operation, or modulation type operation. For example, staged operation may have two flame settings, where modulation type operation may be incrementally adjustable over a large range of outputs, for example from 40% to 100% output capacity.

The air/fuel mixture may travel from the air/fuel mixing box 105 into the heat exchanger inlet tubes 120. The heat exchanger inlet tubes 120 may be constructed of a cylindrical piece of metal having a slightly larger inner diameter than the outer diameter of cavity burners 125. The cavity burners 125 may be perforated to allow the air/fuel mixture through the walls of the cavity burners 125. For example, the cavity burners 125 may comprise a great number of small perforations over a substantial portion of the cylindrical walls and end walls of the cavity burners 125.

The cavity burners 125 may be substantially coaxially received within the heat exchanger inlet tubes 120. By positioning the cavity burners 125 within the heat exchanger inlet tubes, the cavity burners 125 are within a combustion airflow path, therefore substantially all of the combustion air passes through the cavity burners 125. The cavity burners 125 may be substantially cylindrical in shape, open on one end, and closed on the opposite end. The open end of the cavity burners 125 may be positioned at input openings of the heat exchangers 140. Each cavity burner 125 may have an associated heat exchanger 140 for venting hot flue gasses such that the heat exchanger 140 is in the combustion airflow path of the associated cavity burner 125. While four cavity burners 125 are depicted, the total number of cavity burners 125 may vary depending upon the desired capacity of the furnace.

An igniter mounted to the post combustion chamber 135 may be positioned at the opening of one of the cavity burners 125 to ignite the air/fuel mixture in one of the cavity burners 125. The remaining cavity burners 125 may be ignited by a flame carry over path. The flame carry over path may connect the cavity burners 125. The flame in the cavity burners 125 may be counter-flow to the direction of combustion gas flow in the system, resulting in substantially all of the air/fuel mixture passing through the perforations in the cavity burners 125 to the flame. The combustion of the air/fuel mixture substantially occurs inside the cavity burners 125 along the inner perforated surfaces of the cavity burners 125. Combustion inside the cavity burners 125 may allow substantially all of the heat of combustion to be focused at the opening of the cavity burners 125. Combustion air may be introduced either in induced draft mode, by pulling air through the system, or in forced draft mode by pushing air through the system. Induced draft mode may be accomplished by attaching a blower or fan at the exhaust of the heat exchanger exhaust chamber 145 and pulling air out of the system by creating a relatively lower pressure at the exhaust of the heat exchanger exhaust chamber. Forced draft mode may be accomplished by placing a blower or fan at the air/fuel mixing box and forcing air into the system through the air/fuel mixing box. A control system may control the fan or blower to an appropriate speed to achieve adequate air flow for a desired firing rate through the cavity burners 125. Increasing the fan speed of the combustion blower will introduce more air to the air/fuel mixture, thereby changing the characteristics of the combustion in the cavity burners 125.

Substantially enclosing the cavity burners 125 within the heat exchanger inlet tubes 120 and substantially containing combustion within the cavity burners 125 may reduce the amount of thermal radiation emitted to parts of the furnace 100 other than the heat exchangers 140. The open ends of the cavity burners 125 are attached to the post combustion chamber 135. However, in alternative embodiments, the cavity burners 125 may be positioned differently and/or the flow of the air/fuel mixture may be passed through the cavity burners 125 in a different manner. The post combustion chamber 135 is attached directly to an opening on the heat exchangers 140 to ensure that substantially all of the heat generated by the cavity burners 125 may be transferred directly into the heat exchangers 140 by directing hot flue gasses into the heat exchangers 140. The post combustion chamber 135 seals the system from secondary dilution air as well as positions the cavity burners 125 for transfer of the hot flue gasses to the heat exchangers 140. The heat exchangers 140 may be, for example, be clamshell, tubular, drum or shell and tube type heat exchangers.

Figure 2:
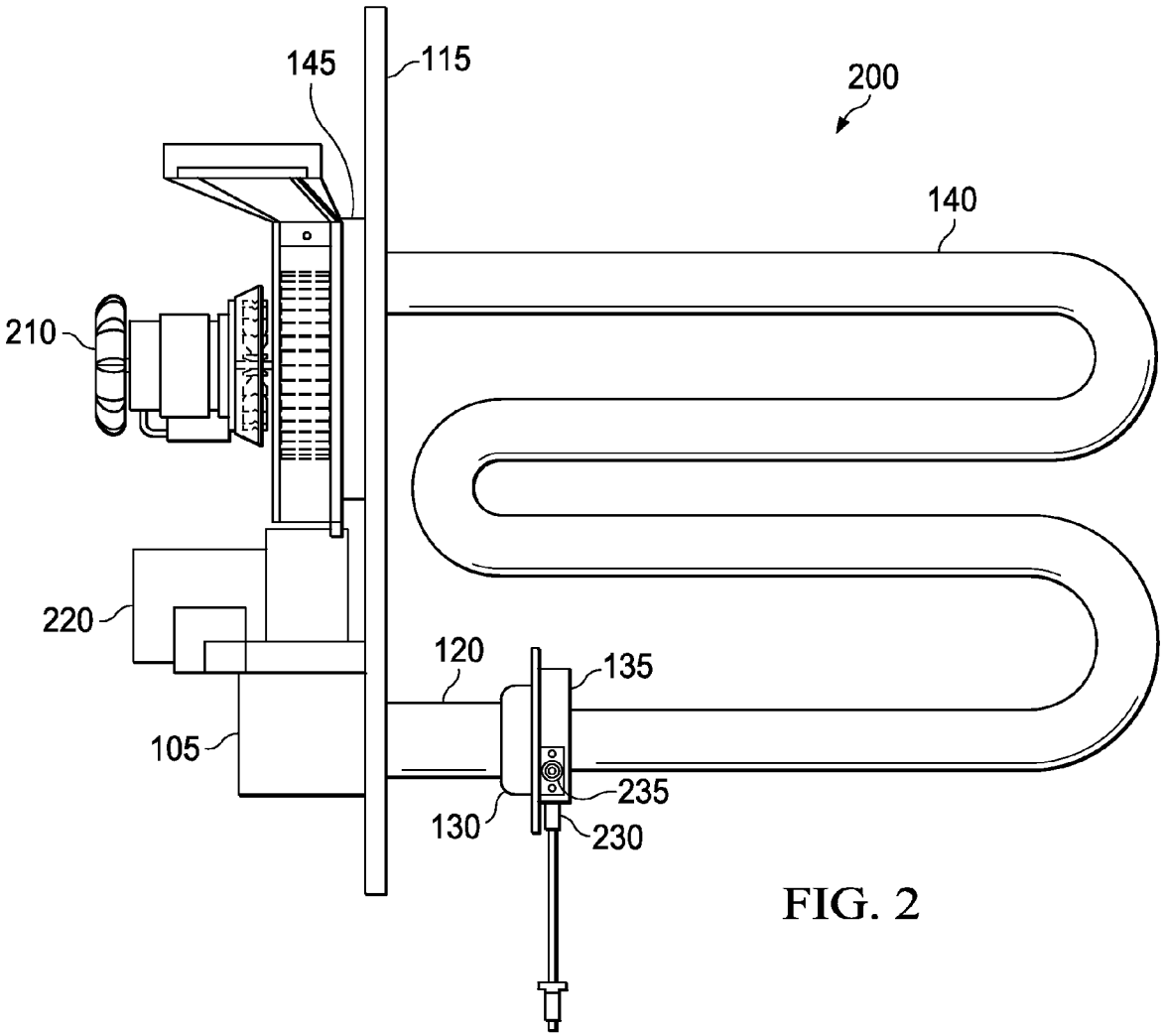
FIG. 2 is an orthogonal simplified view of a gas-fired furnace with cavity burners according to an embodiment of the disclosure.

Turning now to FIG. 2, another gas-fired furnace 100 with cavity burners is depicted. In this embodiment, the furnace 100 further comprises a draft inducer 210, an air/fuel mixer 220, an igniter 230, and a flame sensor 235. The draft inducer 210 may be a fan attached to the heat exchanger exhaust chamber 145 for pulling hot flue gasses through the heat exchangers 140. The draft inducer may be controlled by a control system to ensure appropriate air flow through the system. The igniter 230 may, for example, comprise a pilot light, a piezoelectric device, or a hot surface igniter. The igniter 230 may be controlled by a control system or may be manually ignited. The igniter 230 may also comprise a flame sensor such as a thermocouple or another safety device. The flame sensor 235 may comprise a thermocouple, a flame rectification device, or any other suitable safety device.

Figure 3:
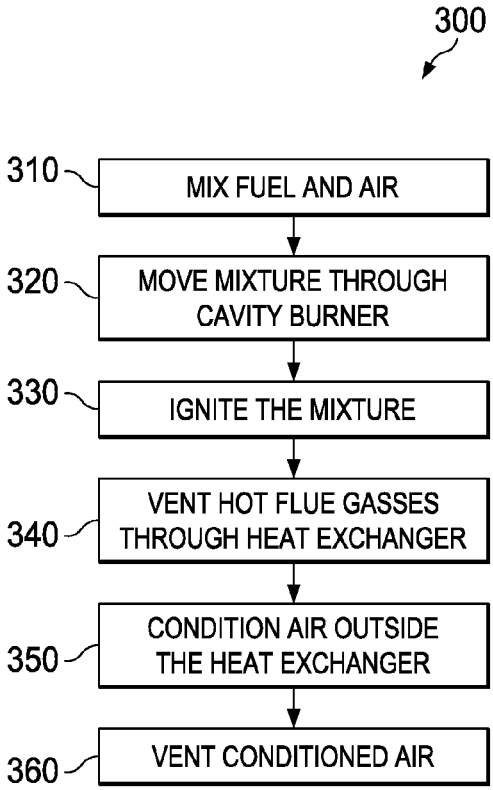
FIG. 3 is a block diagram of a method of air conditioning according to an embodiment of the disclosure.

Referring now to FIG. 3, a block diagram depicting a method 300 of conditioning air is depicted. The method begins at block 310 by mixing a fuel and air together. The fuel may be natural gas available from a gas valve attached to an air/fuel mixing box. The air may be introduced to the air/fuel mixing box by a forced draft or an induced draft. The mixing process may be aided by an air/fuel mixing baffle installed within the air/fuel mixing box. The air fuel mixing baffle may be placed in front of the outlet of the air/fuel mixing box, altering the flow of the air and fuel within the air/fuel mixing box and thereby causing an improved mixing of the air and the fuel. An air/fuel mixer may also be part of the air/fuel mixing box to actively mix the air and fuel within the air/fuel mixing box.

The method continues at step 320 where the air/fuel mixture may be moved through a cavity burner. The cavity burner may have a cylindrical body with an open end and a closed end. The closed end and the cylindrical body may be perforated to allow the air/fuel mixture to pass through into the cavity created by the walls of the cavity burner. The cavity burner may be contained within a heat exchanger inlet tube such that the air/fuel mixture leaving the air/fuel mixing box passes through the perforations of the cavity burner.

The method continues at step 330, where the air/fuel mixture may be ignited. The open end of the cavity burner may face a post combustion chamber. An igniter may be mounted in the post combustion chamber near the opening of the cavity burner. The igniter may be a pilot light, a piezoelectric spark, or a hot surface igniter. As the cavity within the cavity burner fills with the air/gas mixture, the igniter may ignite and cause combustion to begin within the cavity burner.

The method continues at step 340 by venting hot flue gasses through a heat exchanger. Combustion may occur at least partially within an interior space of the cavity burner so that heat is generated and forced out of the open end of the cavity burner and into the post combustion chamber. In this embodiment, the combustion may occur generally within a space bound by the cylindrical wall of the cavity burners 125. Of course, in other embodiments, combustion may occur both within the interior space and outside the interior space, such as in a space generally associated with the open end of the cavity burners 125. Other embodiments may even have the cavity burners 125 with the opening adjacent to the mixing box 105, and the flame situated on the exterior surface of the cavity burner 125. The post combustion chamber may have a heat exchanger attached. The heat exchanger may be tubular in design with a first end connected to the post combustion chamber and a second end connected to a heat exchanger exhaust chamber. The hot flue gasses may be a result of the combustion of the air/fuel mixture and may contain $NO_X$. The level of $NO_X$ in the hot flue gasses may be lowered by varying the combustion temperature of the air/fuel mixture. Combustion within a cavity burner may occur at lower temperatures and have a much smaller flame front area thereby reducing the level of $NO_X$ generated and thereafter present in the flue gasses.

The method continues at step 350 by conditioning air outside of the heat exchanger. As the hot flue gasses travel through the heat exchanger to the heat exchanger exhaust chamber, the heat exchanger may be heated. Air that is exterior to the heat exchanger may be moved across the heat exchanger. As the air moves across the heat exchanger heat may be transferred from the heat exchanger to the air.

The method concludes at block 360 by venting the conditioned air into an air conditioned space, for example, an office space or living area of a home. The heated air may be used to warm the space in order to increase comfort levels for occupants or to maintain the contents of the space at a pre-determined temperature.

Figure 4:
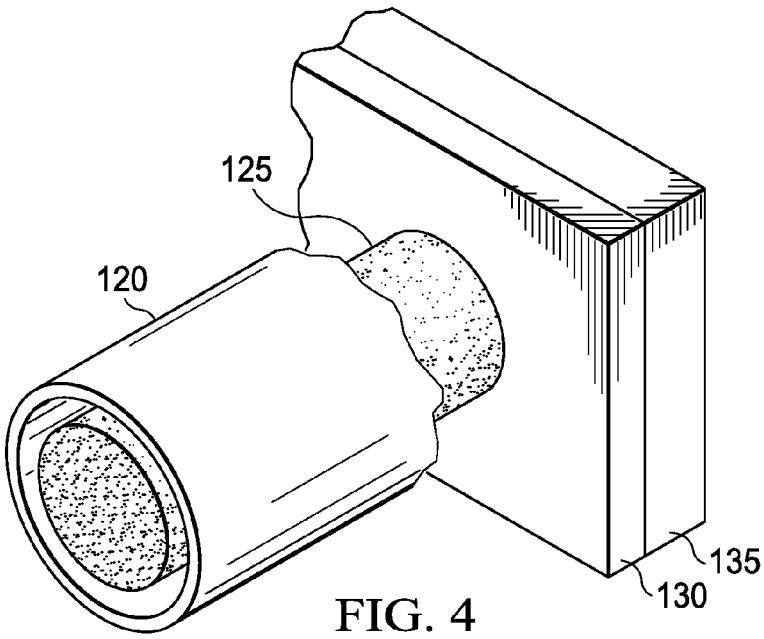
FIG. 4 is a simplified oblique view of a cavity burner received within an inlet tube.

Referring now to FIG. 4 in the drawings, a cutaway view of a cavity burner 125 located within an inlet tube 120 and connected to burner box 130 and post-combustion chamber 135 is shown. In FIG. 4, a portion of the inlet tube 120 is cut away to show that cavity burner 125 resides therein and to show that cavity burner 125 is connected to burner box 130 which is connected to post-combustion chamber 135.

Figure 5:
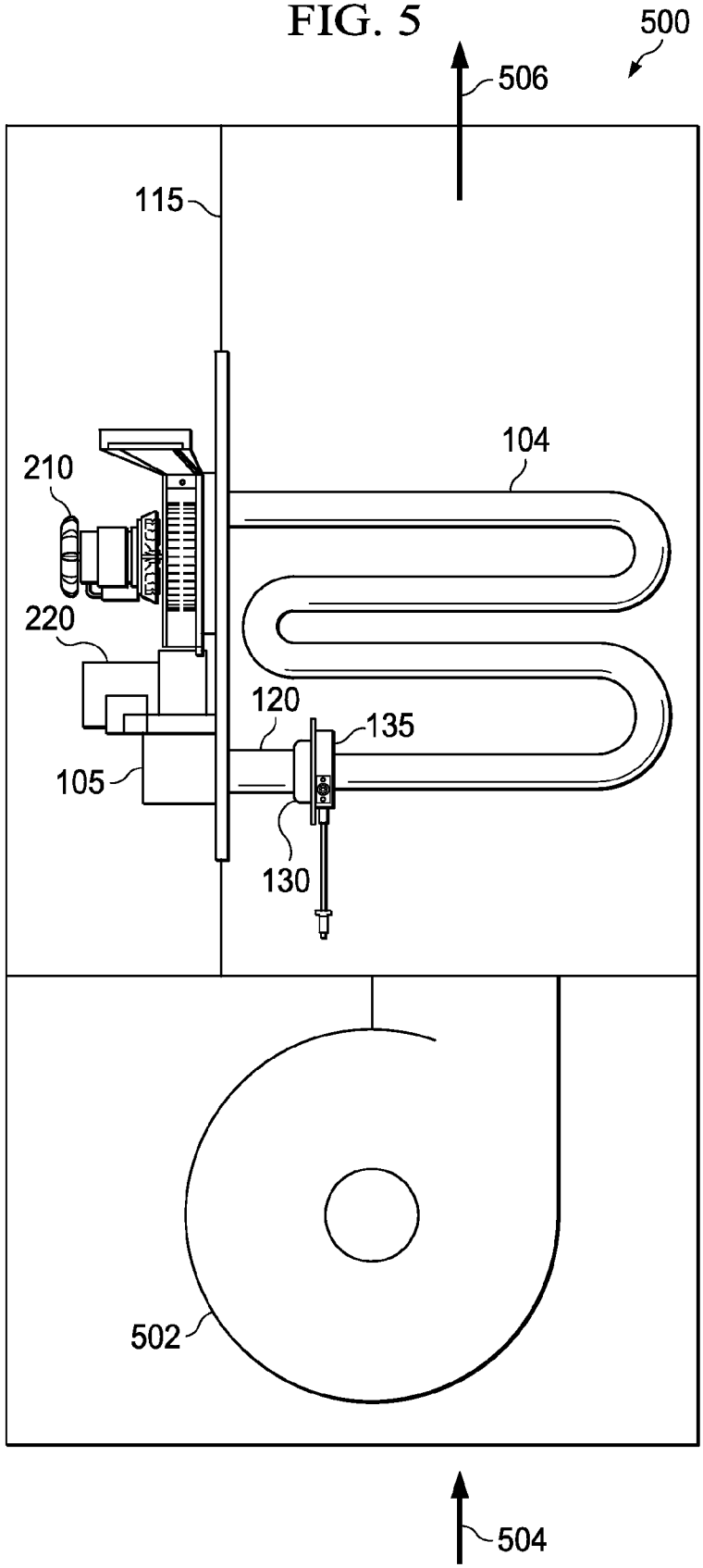
FIG. 5 is a simplified schematic view of a gas-fired furnace comprising a cavity burner and an associated heat exchanger.

Referring now to FIG. 5, a gas-fired furnace 500 is shown. Gas-fired furnace 500 comprises a circulation air blower 502 that receives incoming airflow 504 and passes incoming airflow 504 into contact with heat exchangers 140 to transfer heat from the heat exchangers 140 to the air. Exiting airflow 506 is distributed to an area that is to be conditioned with the heated air.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A gas-fired air conditioning furnace, comprising:

a plurality of cavity burners configured to combust an air-fuel mixture at least partially within an interior space of the cavity burners, the cavity burners comprising a substantially cylindrical tubular shape wherein the cavity burners comprises a plurality of perforations in a wall of the cavity burners, the plurality of perforations being configured to receive the air-fuel mixture therethrough;

a plurality of heat exchangers configured to receive the air-fuel mixture from the cavity burners and to transfer heat from the air-fuel mixture to an airflow associated with an exterior of the heat exchangers; and an inlet tube at least partially located within a path of the airflow and configured to at least partially receive the cavity burners;

wherein the outputs of the plurality of cavity burners are combined in a post-combustion chamber and wherein the output of the post-combustion chamber feeds the plurality of heat exchangers.

2. The gas-fired air conditioner furnace of claim 1, wherein a tubular shape of the inlet tube is complementary to a tubular shape of the cavity burners and wherein the air-fuel mixture is received between the cavity burners and the inlet tube.

3. A method of operating a gas-fired furnace, comprising:

flowing an air-fuel mixture into a plurality of cavity burners through perforated walls of the cavity burners;

combusting at least a portion of the air-fuel mixture within an interior space of the cavity burners;

flowing the at least partially combusted air-fuel mixture from the cavity burners and into a plurality of heat exchangers, wherein the heat exchangers are configured to transfer heat from the at least partially combusted air-fuel mixture to an airflow associated with an exterior of the heat exchangers;

prior to flowing the air-fuel mixture through the perforated walls, flowing the air-fuel mixture between the perforated walls and inlet tubes that complementarily receive at least a portion of the perforated walls; and locating at least a portion of the inlet tubes within a path of the airflow;

wherein the outputs of the plurality of cavity burners are combined in a post-combustion chamber and wherein the output of the post-combustion chamber feeds the plurality of heat exchangers.

4. The method of claim 3, wherein the perforated walls are substantially cylindrically shaped.

5. The method of claim 3, wherein flames are formed along a curved interiors of the perforated walls.

6. The method of claim 3, further comprising:

flowing air across an exteriors of the heat exchangers.

7. The method of claim 3, further comprising:

mixing the air-fuel mixture in mixture boxes prior to flowing the air-fuel mixture into the cavity burners.

8. The method of claim 7, further comprising:

distributing the air-fuel mixture from the mixture boxes into the plurality of cavity burners.

9. The method of claim 3, further comprising:

igniting the air-fuel mixture from a location outside the cavity burners.

10. The method of claim 3, wherein the flowing of the air-fuel mixture into the cavity burners is accomplished by an induced draft of the air-fuel mixture.

11. The method of claim 3, wherein the flowing of the air-fuel mixture into the cavity burners is accomplished by a forced draft of the air-fuel mixture.

12. A gas-fired air conditioning furnace, comprising:

a plurality of cavity burners configured to combust an air-fuel mixture at least partially within an interior space of the cavity burners, each of the cavity burners comprising:

a substantially cylindrical tubular shape;

a substantially flat and perforated end cap disposed upstream relative to the interior space and configured to receive the air-fuel mixture;

an inlet tube configured to at least partially receive the cavity burner;

wherein each of the cavity burners comprises a plurality of perforations in a wall of the cavity burner, the plurality of perforations being configured to receive the air-fuel mixture therethrough; and wherein the inlet tube is at least partially located within a path of the airflow; and a post-combustion chamber configured to receive and combine the air-fuel mixture from the cavity burners, wherein the interior space of the cavity burners is substantially open to an interior space of the post-combustion chamber, and wherein a plurality of heat exchangers are configured to receive the air-fuel mixture from the post-combustion chamber and to transfer heat from the air-fuel mixture to an airflow associated with an exterior of the heat exchangers.

* * * * *